US005197357A

United States Patent [19]

Cote

[11] Patent Number: 5,197,357

[45] Date of Patent: Mar. 30, 1993

[54] DOOR HANDLE ASSIST—MULTI-USE

[76] Inventor: David A. Cote, 13 Cote Ave., S. Ashburnham, Mass. 01430

[21] Appl. No.: 914,515

[22] Filed: Jul. 17, 1992

[51] Int. Cl.[5] ..... B25B 9/00

[52] U.S. Cl. ..... 81/15.9; 81/488; 7/100; 7/170

[58] Field of Search ..... 81/15.9, 488; 254/131; 7/100, 170, 169

[56] References Cited

U.S. PATENT DOCUMENTS

| | | | |
|---|---|---|---|
| 2,681,791 | 6/1954 | Hahn | 254/131 |
| 3,286,988 | 11/1966 | Du Faur | 254/131 |
| 3,908,438 | 9/1975 | Norden | 254/131 |
| 4,012,074 | 3/1977 | O'Reilly | 254/131 |
| 4,236,427 | 12/1980 | Becnel | 81/15.9 |
| 4,507,988 | 4/1985 | LoFaso | 81/3.09 |
| 4,788,893 | 12/1988 | Sutton | 81/15.9 |

OTHER PUBLICATIONS

Publication entitled "Urban Survival Kit".

*Primary Examiner*—Roscoe V. Parker
*Attorney, Agent, or Firm*—Charles R. Fay

[57] ABSTRACT

A universal tool or device for enabling persons with impaired hands to more easily open automobile doors whether they have a fixed type handle or a movable type handle. It is a six inch cylindrical solid member e.g. having at one end an inwardly and downwardly extending slot for use in opening the movable type door handle, and swingable on the body of the device there is a hook having a bight adapted to be placed over the fixed handle and utilizing an end portion of the device for simultaneously impinging upon the usual fixed handle latch opening the door.

2 Claims, 2 Drawing Sheets

DOOR HANDLE ASSIST—MULTI-USE

BACKGROUND OF THE INVENTION

There are people who are arthritic, mal-formed or just so weakened, that they have difficulty in opening doors, especially the doors of automobiles. These doors are generally of two kinds; one kind merely requires turning and another type of door handle requires pushing a button. This invention is an aid for such people to allow them to open automobile doors by actuation of the handle.

Also, this tool is useful to aid people with long fingernails to protect them from breaking while opening doors.

SUMMARY OF THE INVENTION

This invention comprises physically an approximately 6" long cylindrical body member of solid plastic, hollow plastic, solid wood or tubular steel, or any other material which may be useful. This body has at one end an inwardly directed downwardly inclined slot and the bottom of the slot is more or less parallel to the body. This slot is used to lever a movable type of automobile door handle upwardly in a position to unlatch the same to more easily open the door. At its opposite end the device may be provided with a key holder or the like. This is optional.

Immediate the ends of the body there is a provided a swinging hook having a bight which is adapted to hook over a fixed door handle, but when not in use it dangles from the main body of the device by means of a bend in the hook material passing through the device and this acts as an axle. This hook is for the purpose of hooking over a fixed door handle having a button underneath it which has to be pushed in order to unlatch the door to open the same. The slot is applied directly to a movable handle and provides a mechanical advantage to "lift" or pivot the movable handle to unlatch the door lock and pull the door open.

All of these features are directed towards amplifying the force applied by a person who is infirm, arthritic, etc., in order to more easily open a door handle for such afflicted person.

PREFERRED EMBODIMENTS OF THE INVENTION

Figure 1:
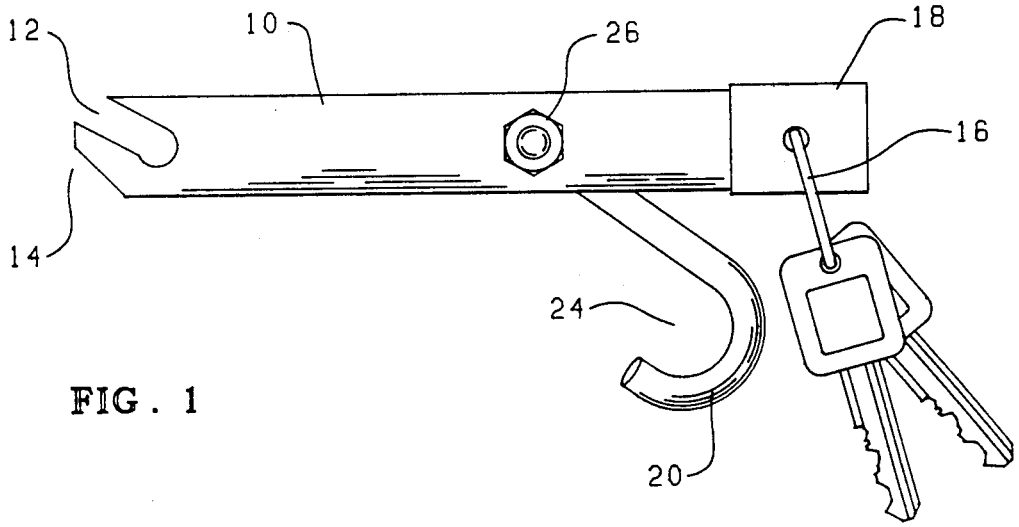
FIG. 1 is a view of side elevation of the device showing the forward slot, the hook and if desired, the keys attached.
Figure 2:
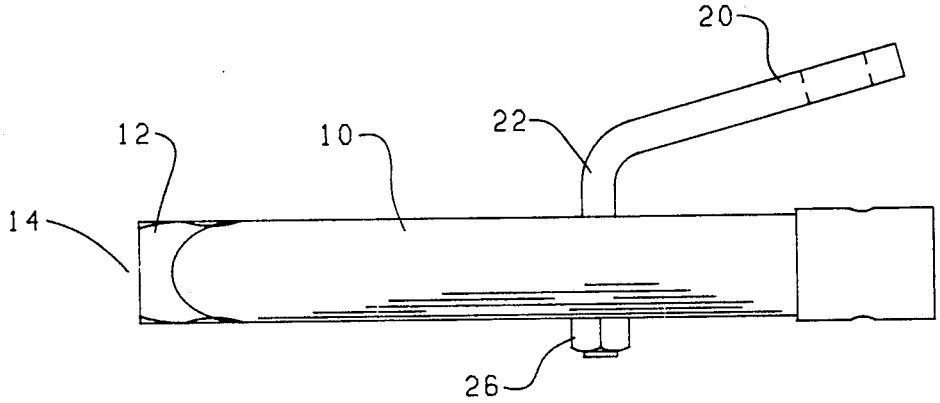
FIG. 2 is a plan view of the above omitting the keys.

First describing the device itself, it is shown in FIGS. 1 and 2 and includes a relatively short but elongated relative to its diameter, a body comprising a length of wood, metal, plastic, etc. or other useful material indicated at 10, and here shown as cylindrical. This cylindrical member has a slot 12 adjacent the end 14. This slot extends inwardly and downwardly as shown and across the diameter of the device, see FIG. 2.

A means 16 may be applied as desired to hold the auto keys.

Immediate the ends there is a removable, swingable hook indicated at 20. This hook has an angularly bent portion 22 that extends through the body of the device which has an opening there through made for it but. The bight of the hook at 24 is directed upwardly as shown in FIG. 1 and offset to some degree by the bent portion 22. This portion may threaded and have a clamping nut as at 26 to secure the hook to the main body member 10. The material of which the hook is made is preferably steel.

Figure 3:
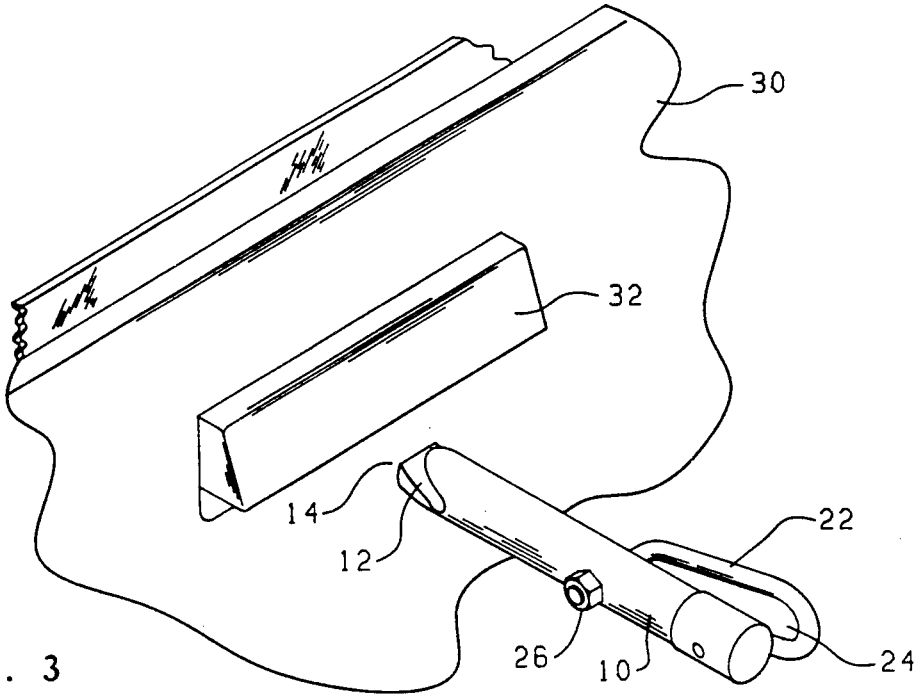
FIG. 3 is a view showing how the slot and the tool are applied to a movable handle.
Figure 4:
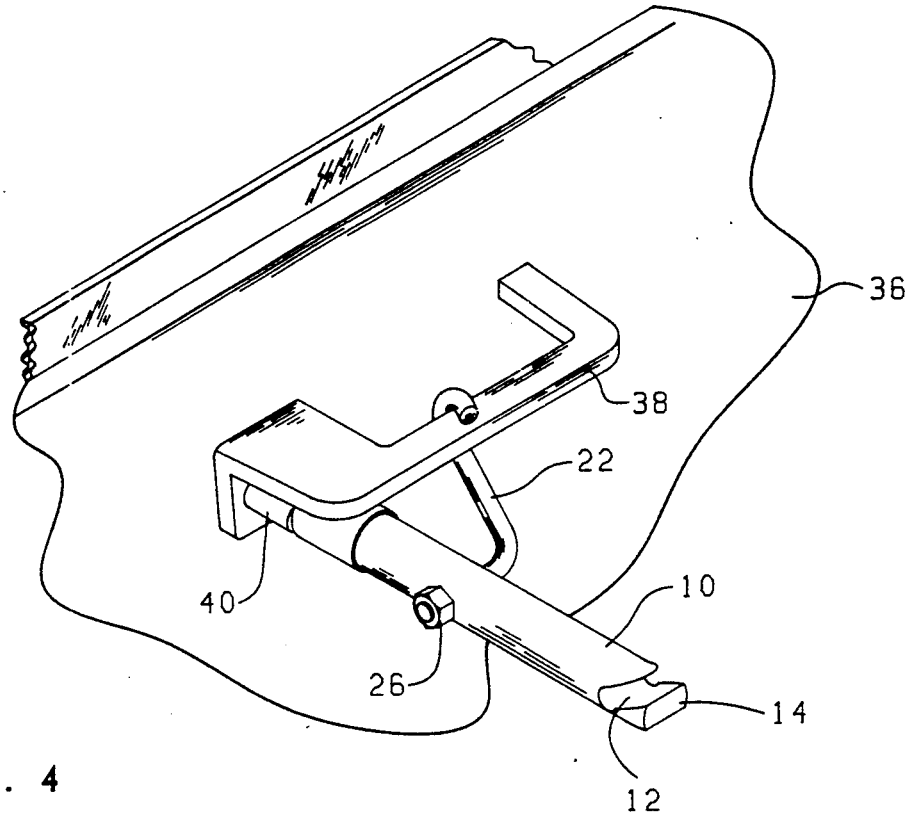
FIG. 4 shows the same actin with regard to a form of door handle which is fixed; and is usually a passenger door handle.
Figure 5:
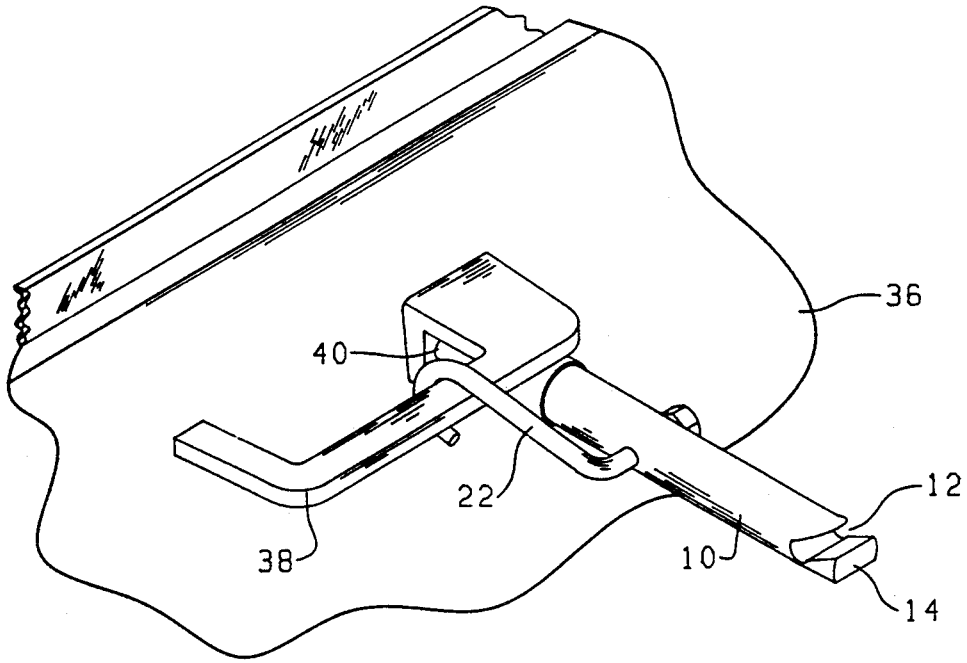
FIG. 5 is similar to FIG. 4 but the door is a driver seat door.

The use of the device as shown in FIGS. 3 to 5, wherein the numeral 30 indicates an automobile door at the outside aspect thereof, and this door has a movable handle 32 attached to a latch so that the member 32 must be lifted up (rotated) in order to unlatch the door from its frame. The device 10 is applied to the member 32 by slot 12 and is used to lift the same upwardly making it easier for a impaired person to force the member 32 outwardly in order to open the door.

In FIG. 5 there is shown an automobile door 36 which has a fixed handle 38. A button 40 which is pushed in with the hand or fingers to that a normal person can push the button with his thumb to unlatch the door, and at the same time pull the door outwardly to open the same. The body 10 is applied as shown in FIG. 5 so that the front end as at 14 abuts the button 40 and the hook is placed over the fixed handle 38 as illustrated in FIG. 4. Now the impaired person may bear down on the body 10 so that it swings about the bent part 22 of the hook.

In case of need the hook may be easily removed and placed on the other side of the body 10 as will be apparent, but in order to open a driver's door the bight of the hook must be inserted from the bottom because the latch releasing buttons are placed differently as to passenger doors and drivers' seat doors. This is shown in FIG. 4 which shows a door handle for a passenger's seat door wherein the button 40 is to the right instead of to the left for a passenger seat door. Otherwise FIGS. 4 and 5 are the same.

It will be seen that this device is conducive to aid in aiding an impaired person so as to help him in opening the car door, either passenger side door, or driver's side door.

FIGS. 4 and 5 should be regarded at the same time. In these figures the reference numbers are the same except the hook 22 in FIG. 4 is inserted from bottom of the handle in FIG. 4. In other words, the device is equally useable with the bight of the hook directed up or down by merely turning the device over 180°.

It will be noticed that the door having the fixed handle and the depressible latch button is provided in such a way that the button is directly under a portion of the handle so that this makes it necessary for the hook to be offset from the button as plainly shown in FIG. 4. In FIG. 5 the button is placed under the handle in the same way but at the other end of the door handle and for this reason the supplementary hook is extended away from the body portion of the tool in the opposite direction.

I claim:

1. A universal tool for opening doors of automobiles, said tool comprising a body portion in a form of a short member adapted to fit the hand, a slot at one end of said member, said slot extending inwardly and downwardly thereof for a short distance inwardly from said end, and a hook-like member pivotally mounted on said body member at a point spaced from said slot, said hook being freely rotatable, the hook being adapted to be placed over the fixed handle of the door at the outside aspect thereof and the portion of the body member adjacent the slot being adapted to be positioned to engage the latch releasing button for opening the automobile door and wherein the slot is alternatively adapted to be positioned on a movable automobile door handle so as to receive the same providing easier pivoting of the handle, the hook having a bight that is directed up or down according to need.

2. An automobile door handle assist for opening a fixed handle having a button unlatching device adjacent the end of the fixed handle and underneath the same, said assist comprising a handle for manual use, said handle having an axis and a hook on the handle, means on the handle rotatively mounting the hook on the handle in position to provide for the handle to swing on an axis, at a general right angle to said handle axis, a shank for the hook to so move, and a bight at the end of the hook remote from the hook axis, said shank being at an acute angle with respect to the axis of the handle so that the hook is spaced from the handle, said handle having a butt end adapted to engage and push the button as the hook is placed over the door handle or handle being turned over to a position at 180° of the first named position according to the position of the button relative to the handle.

* * * * *